US005321473A

United States Patent [19]

Azami

[11] Patent Number: 5,321,473

[45] Date of Patent: Jun. 14, 1994

[54] SEALING MEMBERS FOR A DEVELOPING DEVICE IN AN IMAGE FORMING APPARATUS

[75] Inventor: Akira Azami, Tokyo, Japan

[73] Assignee: Ricoh Company, Ltd., Tokyo, Japan

[21] Appl. No.: 38,685

[22] Filed: Mar. 29, 1993

[30] Foreign Application Priority Data

Mar. 30, 1992 [JP] Japan ..... 4-074437

[51] Int. Cl.[5] ..... G03G 15/06

[52] U.S. Cl. ..... 355/245; 355/215

[58] Field of Search ..... 355/260, 245, 215; 222/DIG. 1

[56] References Cited

U.S. PATENT DOCUMENTS

| | | | |
|---|---|---|---|
| 4,800,411 | 1/1989 | Tanaka et al. | 355/215 |
| 4,897,693 | 1/1990 | Sawayama | 355/215 |
| 5,057,868 | 10/1991 | Sekino et al. | 355/215 |
| 5,134,960 | 8/1992 | Shirai | 355/215 X |
| 5,166,733 | 11/1992 | Eliason | 355/215 X |
| 5,212,521 | 5/1993 | Ogawa et al. | 355/215 |

FOREIGN PATENT DOCUMENTS 61-90184 5/1986 Japan .

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A developing device incorporated in an image forming apparatus and having a developing roller facing an image carrier via an opening formed through a casing, and a pair of seal members attached to the casing and adjoining opposite side edges of the opening for preventing a developer from being scattered around. The seal members each has a side seal portion for sealing the associated side edge of the opening, and an under seal portion extending from the lower end of the side seal portion. The under seal portion extends from the side seal portion toward the center of the developing roller, providing the entire seal member with a form of a letter L.

8 Claims, 7 Drawing Sheets

SEALING MEMBERS FOR A DEVELOPING DEVICE IN AN IMAGE FORMING APPARATUS

BACKGROUND OF THE INVENTION

The present invention relates to a copier, facsimile apparatus, printer or similar image forming apparatus and, more particularly, to a developing device of the type having a developing roller facing an image carrier via an opening formed in a casing, and a pair of seal members provided on the casing and adjoining opposite side edges of the opening for preventing a developer from being scattered around.

The problem with a developing device of the type described is that during development a developer is scattered around via opposite side edges of the opening of the casing since a developing roller facing a photoconductive drum or similar image carrier cannot strongly retain the developer at opposite ends thereof. To eliminate this problem, it is a common practice to attach seal members to the casing in such a manner as to cover the opposite side edges of the opening. The seal members may be implemented as sheets of polyurethane or similar substance or as elastic members of foam urethane.

However, the seal members in the form of sheets has a drawback that when the amount of developer deposited on the developing roller increases, the resulting magnet brush is apt to get on the seal members and be scattered around via the clearance between the seal members and the drum. Moreover, the carrier particles contained in the developer is spun off due to the rotation of the developing roller and directly scattered to the outside. Such carrier particles are also scattered around via the clearance between the drum and the lower portion of the casing. By contrast, the seal members made of an elastic material prevent the magnet brush from getting thereon and also prevents the carrier particles spun off from being directly scattered to the outside since no clearances exist between the seal members and the drum. However, the carrier particles spun off impinge on and rebound from the elastic seal members. This part of the carrier particles is scattered around via the clearance between the drum and the lower portion of the casing without returning to the magnet brush.

Further, a copier, facsimile apparatus, printer or similar machine is apt to incline in the axial direction of a developing roller thereof due to the location where it is installed. Then, despite the seal members, the developer is likely to leak at the lower side of the developing device with respect to the inclination of the machine. Hence, the margin available with the conventional developing device in respect of inclination is limited.

SUMMARY OF THE INVENTION

It is, therefore, an object of the present invention to provide a developing device for an image forming apparatus which surely prevents a developer from being scattered around and accommodates a substantial inclination of the apparatus.

A developing device for an image forming apparatus having an image carrier of the present invention comprises a casing formed with an opening, a developing roller facing the image carrier via the opening of the casing, and a pair of seal members provided on the casing and adjoining opposite side edges of the opening to prevent a developer from being scattered around.

The pair of seal members each comprising a side seal portion sealing an associated one of the opposite side edges of the opening, and an under seal portion extending from a lower portion of the side seal portion toward the center in the axial direction of the developing roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 7:
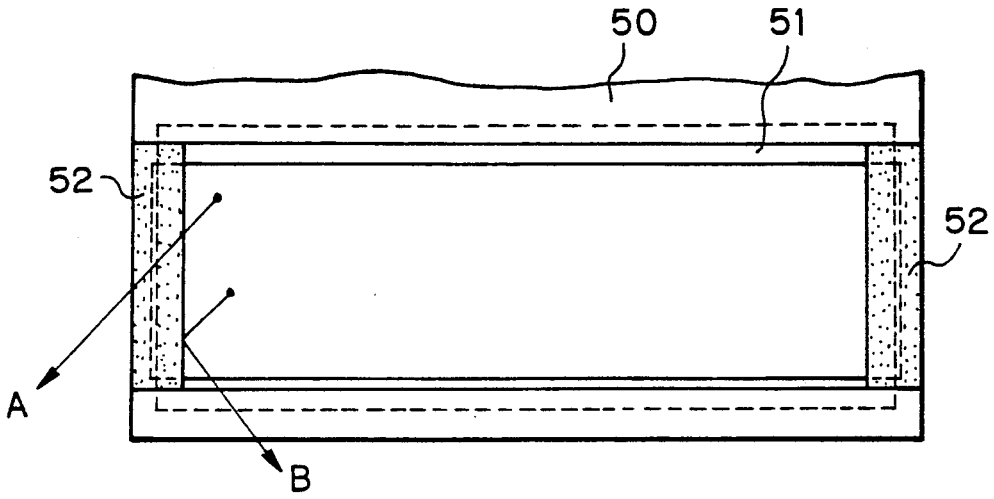
Fig. 7 PRIOR ART
FIG. 7 is a front view showing a conventional developing device.
Figure 8:
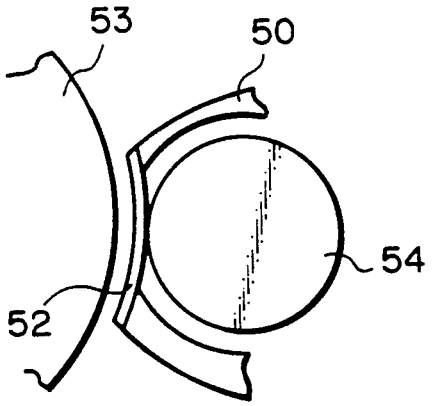
Fig. 8 PRIOR ART
FIG. 8 is a side elevation of the device shown in FIG. 7.
Figure 9:
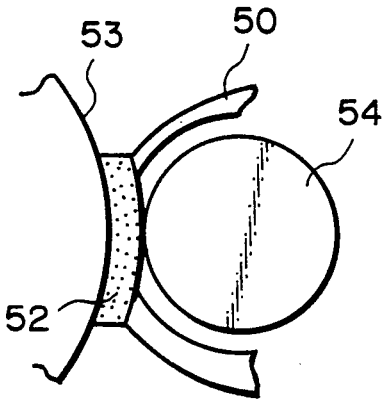
Fig. 9 PRIOR ART
FIG. 9 is a fragmentary side elevation of another conventional developing device.

To better understand the present invention, a brief reference will be made to a conventional developing device, shown in FIG. 7. As shown, the developing device has a casing 50 which is formed with an opening 51. Seal members 52 cover opposite side edges of the opening 51 to prevent a developer from being scattered around therethrough. Otherwise, the developer would be done so since a developing roller facing a photoconductive drum or similar image carrier cannot strongly retain the developer at opposite ends thereof, as stated earlier. The seal members 52 may be implemented as sheets of polyurethane or similar substance, as shown in FIG. 8, or as elastic members of foam urethane, as shown in FIG. 9. The elastic members 52 shown in FIG. 9 hermetically close the space between a photoconductive drum 53 and a developing roller 54.

The problem with the seal members 52 shown in FIG. 8 is that when the amount of developer deposited on the developing roller 54 increases, the resulting magnet brush is apt to get on the seal members 52 and be scattered around via the clearance between the members 52 and the drum 53. Moreover, the carrier particles contained in the developer is spun off due to the rotation of the developing roller 54 and directly scattered to the outside, as indicated by an arrow A in FIG. 7. Such carrier particles are also scattered around via the clearance between the drum 53 and the lower portion of the casing 50.

By contrast, the seal members 52 shown in FIG. 9 prevent the magnet brush from getting thereon and also prevents the carrier particles spun off from being directly scattered to the outside since no clearances exist between the seal members 52 and the drum 53. However, the carrier particles spun off impinge on and rebound from the elastic seal members 52, as indicated by an arrow B in FIG. 7. This part of the carrier particles is scattered around via the clearance between the drum 53 and the lower portion of the casing 50 without returning to the magnet brush.

Further, a copier, facsimile apparatus, printer or similar machine is apt to incline in the axial direction of a developing roller thereof due to the location where it is installed. Then, despite the seal members 52, the developer is likely to leak at the lower side of the developing device with respect to the inclination of the machine. Hence, the margin available with the conventional developing device in respect of inclination is limited, as discussed previously.

Figure 1:
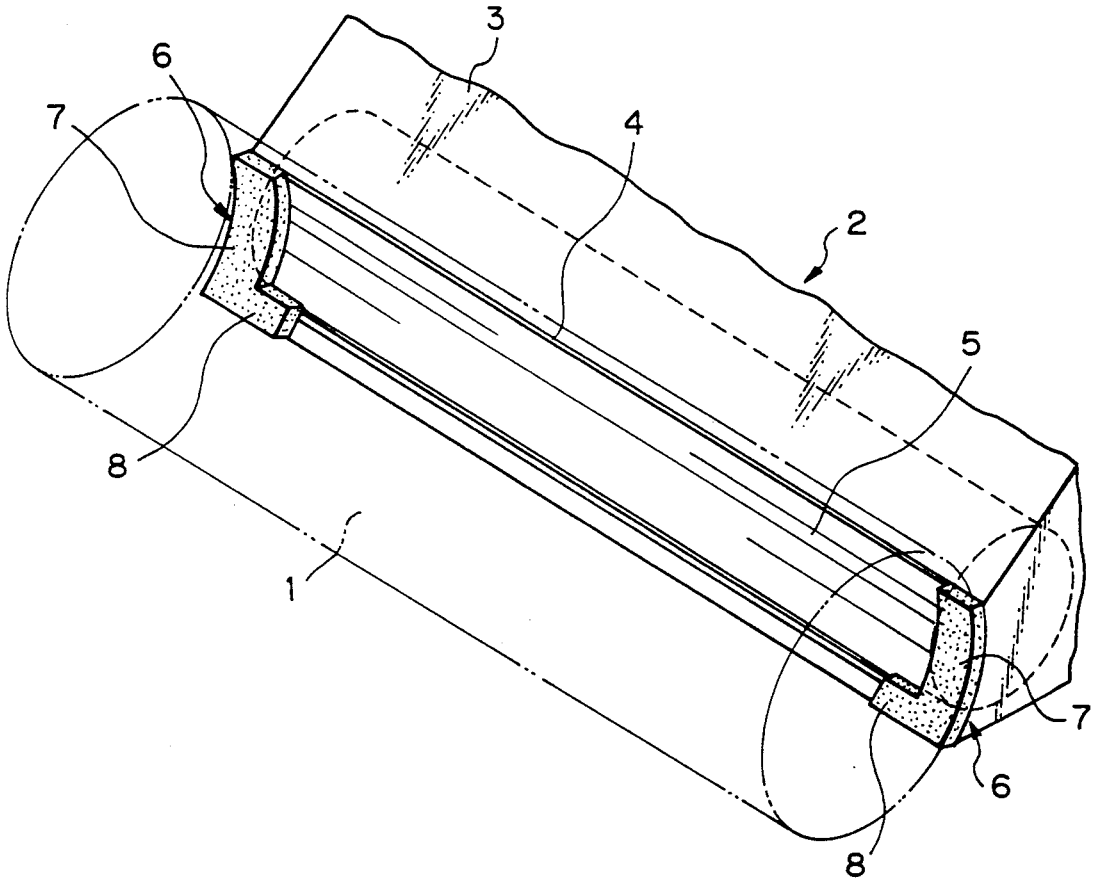
FIG. 1 is a perspective view showing a developing device embodying the present invention.

Referring to FIG. 1, a developing device embodying the present invention is shown and generally designated by the reference numeral 2. As shown, the developing device 2 has a casing 3 having an opening 4 which faces an image carrier implemented as a photoconductive drum 1. A developing roller or magnet roller 5 is accommodated in the developing device 2 and positioned to face the drum 1 via the opening 4. A pair of seal members 6 are attached to the casing 3 at opposite side edges of the opening 4 by an adhesive or similar implementation. The seal members 6 are each made up of a side seal portion 7 adjoining the side of the opening 4, and an under seal portion 8 adjoining the lower portion of the opening 4. The under seal portion 8 extends from the side seal portion 7 toward the center of the developing roller 5. Hence, the entire seal member 6 is configured generally in the form of a letter L.

Figure 2:
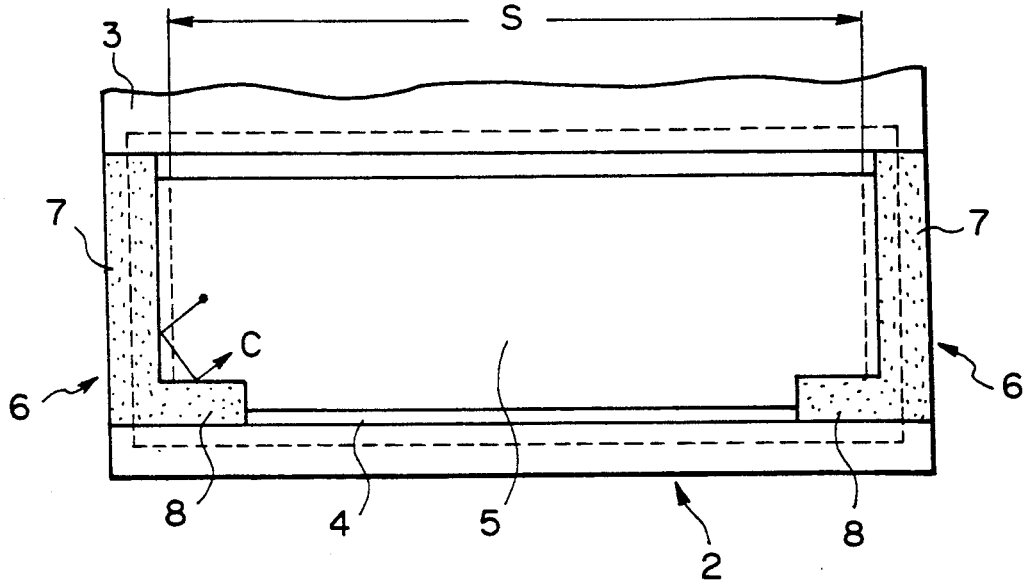
FIG. 2 is a front view of the embodiment.

In the illustrative embodiment, the side seal portion 7 and under seal portion 8 of each seal member 6 are formed integrally by use of foam urethane. The seal member 6 has a thickness greater than the gap between the drum 1 and the developing roller 5 due to the elasticity thereof. The entire surface of the seal member 6 which faces the drum 1 is held in sliding contact with the drum 1. Although the drum 1 and the side seal portion 7 and under seal portion 8 contact each other without any clearance, the two portions 7 and 8 do not exert any excessive load against the rotation of the drum 1. As shown in FIG. 2, assume that the developing roller 5 is magnetized over a range S. Then, the edges of the side seal portions 7 which face each other, i.e., the inner edges of the side seal portions 7 are located at the outside of the range S. On the other hand, the inner edges of the under seal portions 8 facing each other are positioned in the range S.

In operation, as the developing roller 5 is rotated, carrier particles included in a developer are spun off due to the resulting centrifugal force. However, such carrier particles sequentially impinge on and rebound from the side seal portions 7 and under seal portions 8, as indicated by an arrow C in FIG. 2. As a result, the carrier particles are turned to a magnet brush formed on the developing roller 5, noticeably reducing the scattering of the developer. At this instant, the spin-off of carrier particles mainly occurs at laterally opposite regions where the magnetic force of the developing roller 5 is weak. Therefore, the under seal portions 8 can sufficiently prevent the developer from falling only if the inner edges thereof lie in the previously mentioned range S, i.e., even if the side seal portions 8 are not so long in the axial direction of the developing roller 5. Further, since the inner edges of the side seal portions 7 are located at the outside of the range S, the magnet brush is prevented from contacting the side seal portions 7 and, therefore, from being scattered around.

The side seal portion 7 of each seal member 6 has a thickness greater than the gap between the drum 1 and the developing roller 5 due to the elasticity thereof, as stated earlier. As a result, part of the side seal portion 7 slidingly contacts the developing roller 5. In this condition, it may occur that the developer solidifies due to the heat and pressure ascribable to friction, causing an image from being partly lost in the form of white spots.

Figure 3:
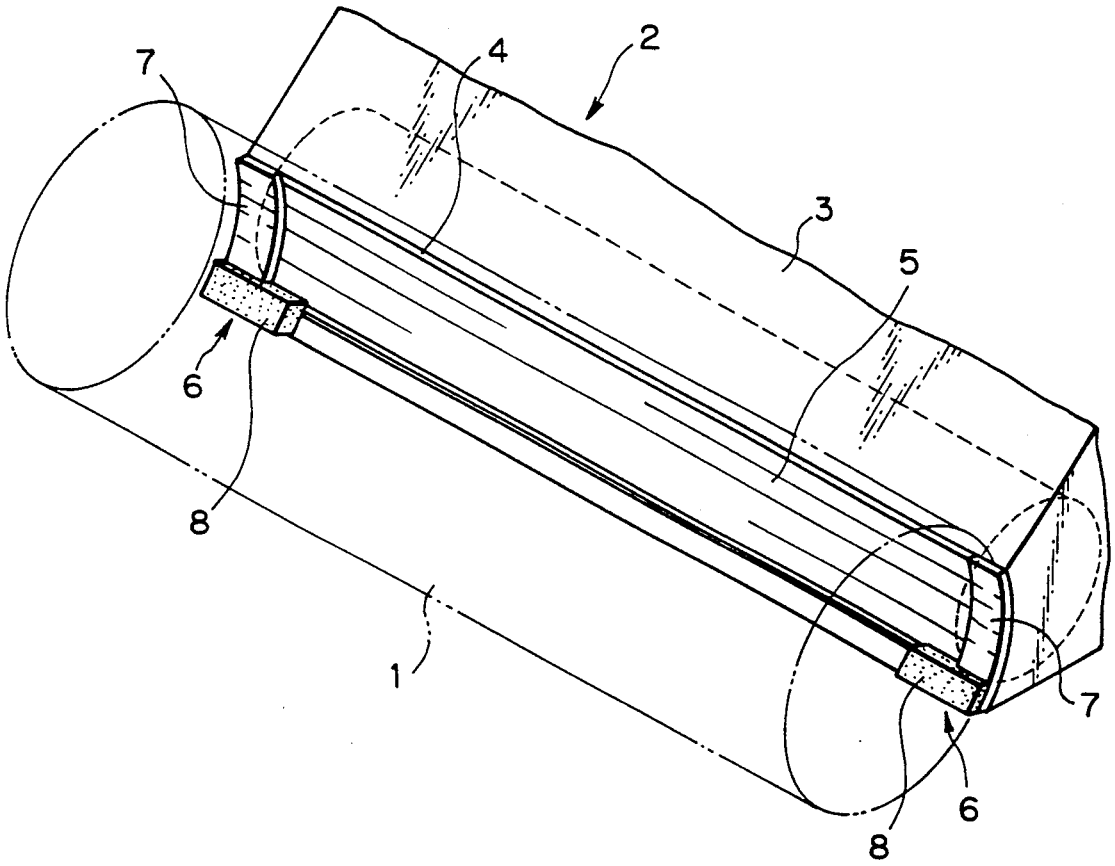
FIG. 3 is a perspective view showing an alternative embodiment of the present invention.

FIG. 3 shows an alternative embodiment of the present invention which eliminates the above-stated problem. As shown, each seal member 6 has a stepped configuration such that the side seal portion 7 is thinner than the under seal portion 8. In this embodiment, the side seal portion 7 is constituted by a sheet of, for example, polyurethane whose thickness is smaller than the gap between the drum 1 and the developing roller 5. The under seal portion 8 is made of foam urethane to have a thickness greater than the gap between the drum 1 and the casing 3 which supports the under seal portion 8.

In the embodiment of FIG. 3, since the side seal portions 7 each has a thickness smaller than the gap between the drum 1 and the developing roller 5, they cause a minimum of friction to occur even though they may contact the developing roller 5. This is successful in preventing the developer from solidifying and, therefore, eliminating the white spots in an image. On the other hand, the under seal portions 8 prevent their surfaces facing the drum 1 from contacting the drum 1. In addition, since the under seal portions 8 are made of foam urethane, they do not exert any load against the rotation of the drum 1. It is to be noted that the seal members 6 may each be implemented as a single molding of foam urethane only if the side seal portion 7 can be provided with a thickness smaller than the gap between the drum 1 and the developing roller 5 and can have a step relative to the under seal member 8.

A series of experiments were conducted to compare the seal members of the developing device 2 of the invention and those of a conventional developing device in relation to the inclination of the machine. There were prepared conventional devices having respectively the side seals shown in FIG. 7 and implemented as polyurethane or similar sheets and the side seals shown in FIG. 9 and made of foam urethane. The developing device 2 of the invention was provided with the seal members 6 of FIG. 1 each having the side seal portion 7 and under seal portion 8 made of foam urethane.

Figure 4:
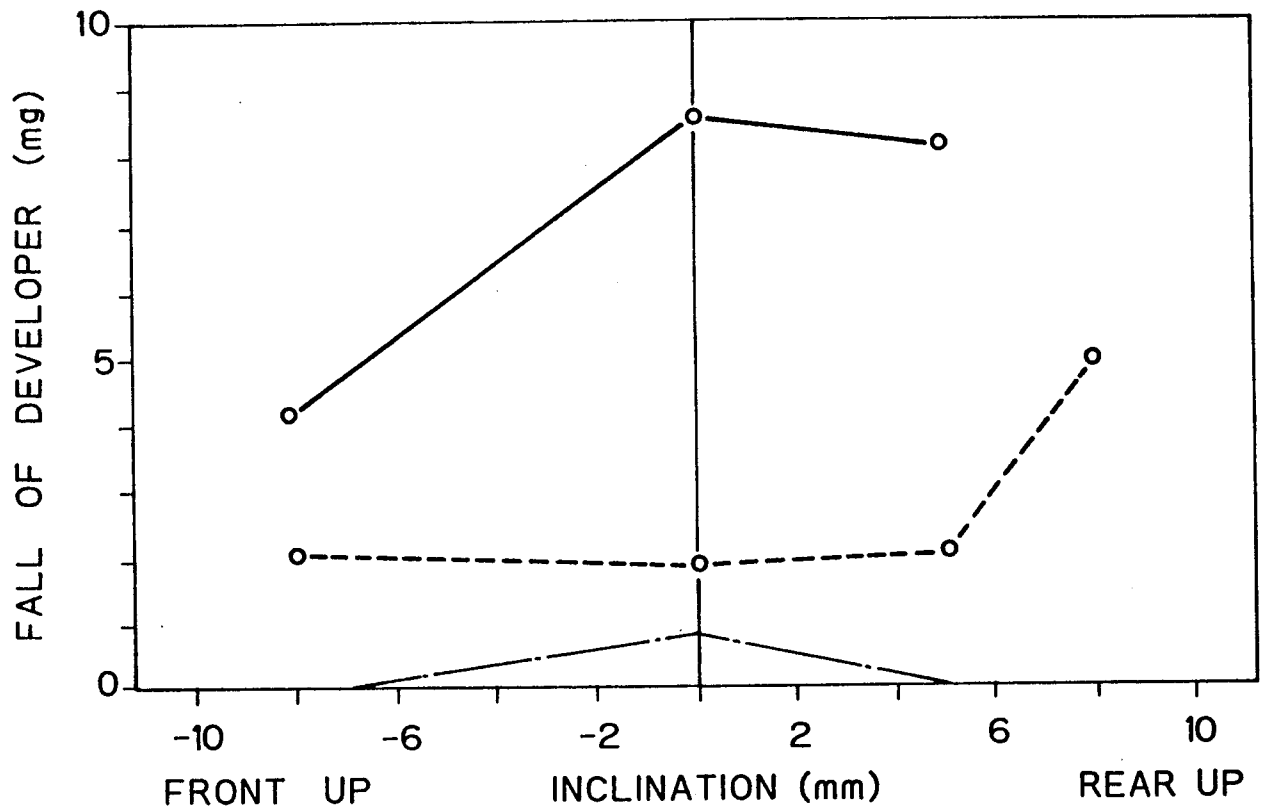
FIGS. 4–6 are graphs each showing a particular relation between the inclination of a developing device and the amount of fall of a developer.
Figure 5:
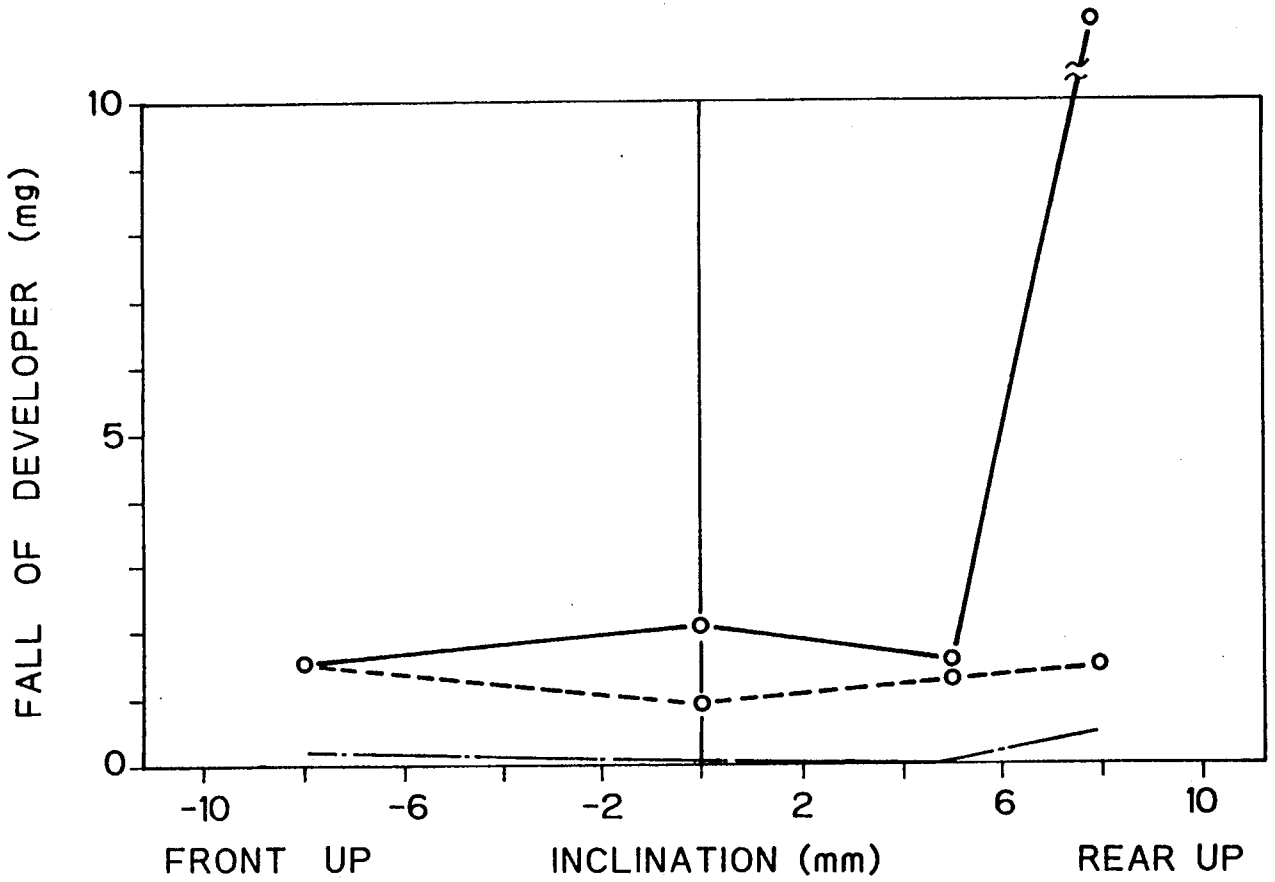
Figure 6:
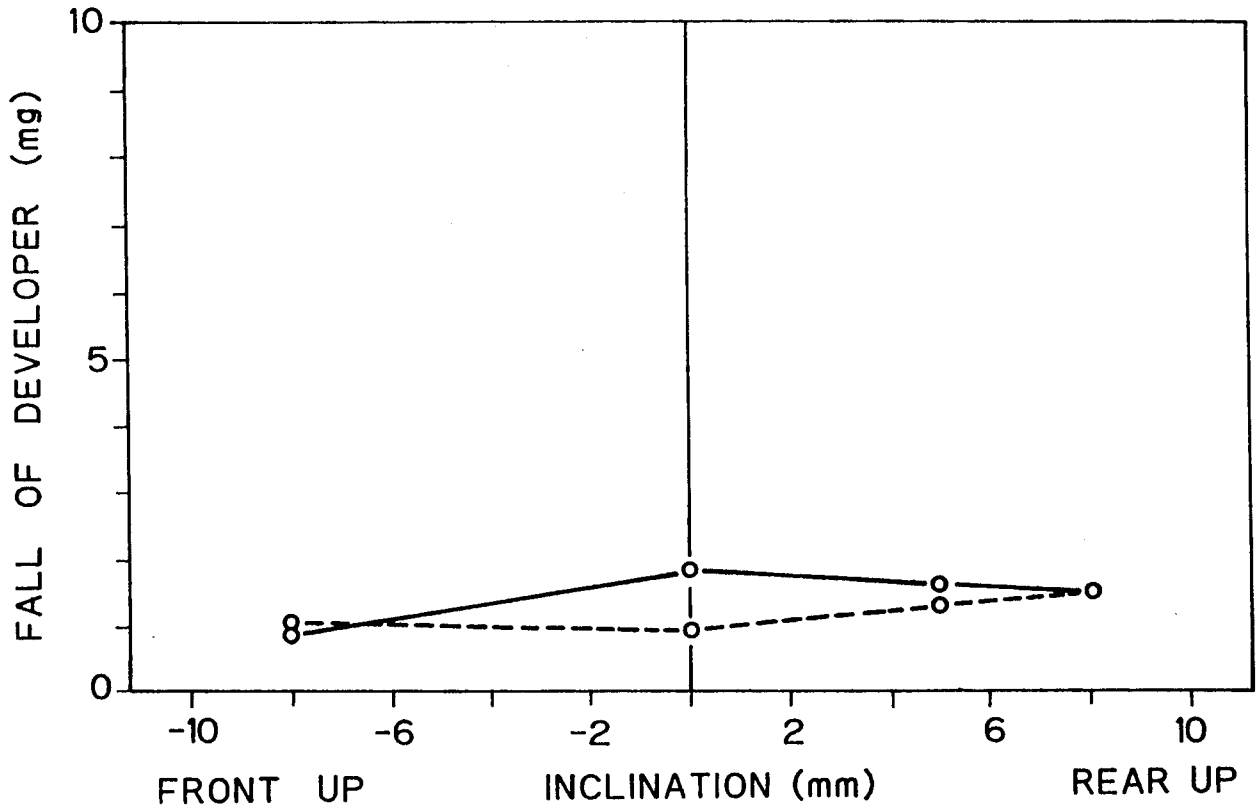

FIGS. 4–6 are graphs each showing a particular relation between the inclination (mm) and the fall of the developer (mg) determined by the experiments. Specifically, the graphs of FIGS. 4–6 are respectively associated with the device having only the seal members or side seals 52 of polyurethane (FIG. 4), the device having only the side seals made of foam urethane (FIG. 5), and the device having the seal members each being made up of the side seal portion 7 and under seal portion 8 of foam polyurethane (FIG. 6). In the graphs, a solid line, a dash-and-dot line and a dotted line indicate respectively the amounts of fall of the developer measured at the front side of the device adjoining one axial end of the developing roller (solid line), the rear side adjoining the other axial end of the roller (dash-and-dot line), and at the center. Further, in the graphs, inclinations positioning the front end of the developing roller at a higher level than the rear end and inclinations positioning the former at a lower level than the latter are respectively indicated at the left-hand side and the right-hand side of the central vertical line which is indicative of a horizontal position.

By comparing FIGS. 4 and 5, it will be seen that even the conventional device reduces the fall of the developer far more when implemented with the elastic seal members than when implemented with the sheet-like seal members. The device of the present invention is not noticeably different from the conventional device of FIG. 5 so long as the inclination ranges from −8 mm to +6 mm. However, when the inclination was such that the rear side is 8 mm higher than the front side, the conventional device caused the developer to fall in an amount as great as 80 mg while the device of the invention caused only 0.2 mg of developer to fall. The present invention, therefore, accommodates a substantial degree of inclination while preventing the fall of the developer.

In summary, it will be seen that the present invention provides a developing device capable of preventing a developer from leaking through between an image carrier and lower part of a casing. Moreover, the device includes under seal portions which noticeably reduce the fall of the developer and, therefore, accommodate a substantial degree of inclination. Side seal portions also included in the device remain clear of a magnet brush at all times. In addition, since the side seal portions are thinner than the under seal portions, the developer is prevented from solidifying due to heat ascribable to friction. The solidification of the developer would cause an image from being partly lost in the form of white spots.

Various modifications will become possible for those skilled in the art after receiving the teachings of the present disclosure without departing from the scope thereof.

What is claimed is:

1. A developing device for an image forming apparatus having an image carrier, comprising:

a casing formed with an opening through which developer is transferred from the developing roller to the image carrier;

a developing roller facing the image carrier via said opening of said casing; and a pair of seal members provided on said casing and adjoining opposite side edges of said opening such that said pair of seal members are disposed between the developing roller and the image carrier to prevent a developer from being scattered;

said pair of seal members each comprising a side seal portion sealing an associated one of the opposite side edges of said opening, and an under seal portion extending from a lower portion of said side seal portion toward a center in an axial direction of said developing roller.

2. A device as claimed in claim 1, wherein ends of the under seal portions of said pair of seal members which face each other lie in a range in which said developing roller is magnetized.

3. A device as claimed in claim 1, wherein edges of the side seal portions of said pair of seal members which face each other are located outside of a range in which said developing roller is magnetized.

4. A device as claimed in claim 1, wherein said side seal portion and said under seal portion are formed integrally with each other and made of foam urethane.

5. A device as claimed in claim 1, wherein said side seal portion has a smaller thickness than said under seal portion in a radial direction of the image carrier.

6. A device as claimed in claim 5, wherein said under seal portion contacting the image carrier is made of foam urethane.

7. A developing device for an image forming apparatus having an image carrier, comprising:

a casing formed with an opening;

a developing roller facing the image carrier via said opening of said casing; and a pair of seal members provided on said casing and adjoining opposite side edges of said opening to prevent a developer from being scattered;

said pair of seal members each comprising a side seal portion sealing an associated one of the opposite side edges of said opening, and an under seal portion extending from a lower portion of said side seal portion toward a center in an axial direction of said developing roller;

wherein the thickness of said side seal portion in the radial direction of the image carrier is smaller than a gap between said image carrier and said developing roller.

8. A developing device for an image forming apparatus having an image carrier, comprising:

a casing formed with an opening;

a developing roller facing the image carrier via said opening of said casing; and a pair of seal members provided on said casing and adjoining opposite side edges of said opening to prevent a developer from being scattered;

said pair of seal members each comprising a side seal portion sealing an associated one of the opposite side edges of said opening, and an under seal portion extending from a lower portion of said side seal portion toward a center in an axial direction of said developing roller wherein said side seal portion has a smaller thickness than said under seal portion in a radial direction of the image carrier;

wherein the thickness of said under seal portion in the radial direction of the image carrier is greater than a gap between said image carrier and a portion of said casing supporting said under seal portion.

* * * * *